US005195782A

United States Patent [19]

Schroeder

[11] Patent Number: 5,195,782

[45] Date of Patent: Mar. 23, 1993

[54] SHEET MUSIC BINDER

[76] Inventor: Karl S. Schroeder, 6822 Salem Ave., Clayton, Ohio 45315

[21] Appl. No.: 792,388

[22] Filed: Nov. 15, 1991

[51] Int. Cl.[5] ..... B42D 3/00

[52] U.S. Cl. ..... 281/48; 281/45; 402/8; 402/19; 248/441.1

[58] Field of Search ..... 281/47, 48, 49, 45; 402/6, 7, 8, 9, 10, 19; 40/111; 248/442.2, 445, 441.1

[56] References Cited

U.S. PATENT DOCUMENTS

| | | | |
|---|---|---|---|
| 104,122 | 6/1870 | Day . | |
| 936,223 | 10/1909 | Dean | 281/48 |
| 1,452,452 | 4/1923 | West | 281/48 |
| 1,596,741 | 8/1926 | Kranz | 281/47 |
| 1,654,191 | 12/1927 | Redies et al. . | |
| 1,736,908 | 11/1929 | Franey | 281/47 |
| 1,842,496 | 1/1932 | Wagner, Jr. | 281/49 |
| 2,079,388 | 5/1937 | Vetor | 281/47 |
| 2,552,704 | 5/1951 | Armstrong et al. | 281/49 |
| 3,176,952 | 4/1965 | Gilmore | 281/47 |
| 4,840,407 | 6/1989 | Schroeder | 281/48 |

*Primary Examiner*—Timothy V. Eley
*Assistant Examiner*—Willmon Friedie, Jr.
*Attorney, Agent, or Firm*—Roger S. Dybvig

[57] ABSTRACT

Folder for replaceable sheet music has an integral elastomeric band consisting of a plurality of stretchable or elastic strands hooked at its ends over outwardly-directed band holders attached to a back panel of the folder. Each strand may be provided with a pull tab for laterally stretching individual strands to accommodtae edgewise insertion and withdrawal of sheet music.

19 Claims, 3 Drawing Sheets

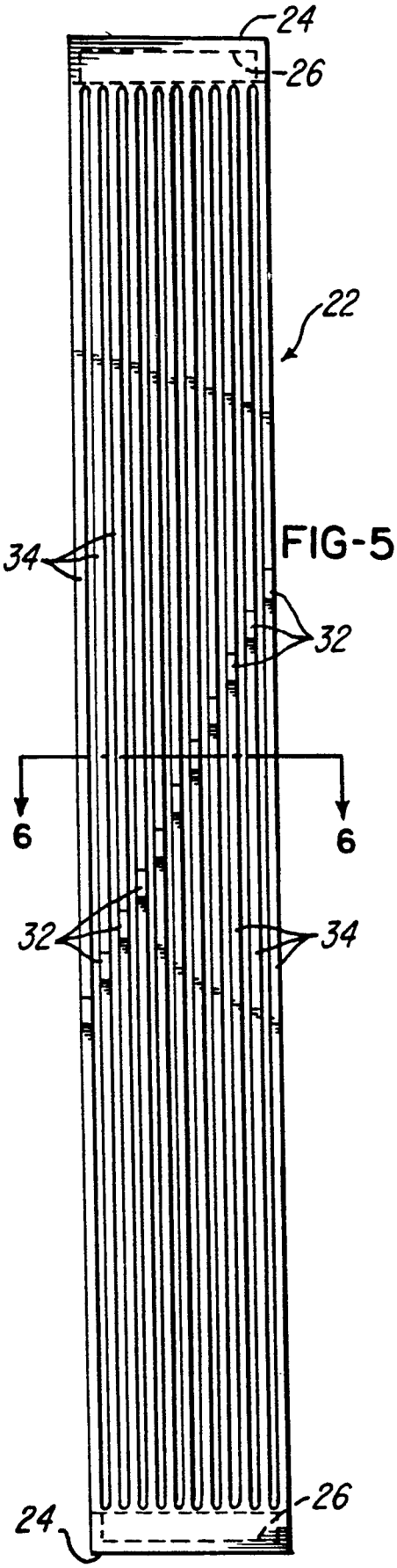
FIG-5
FIG-4
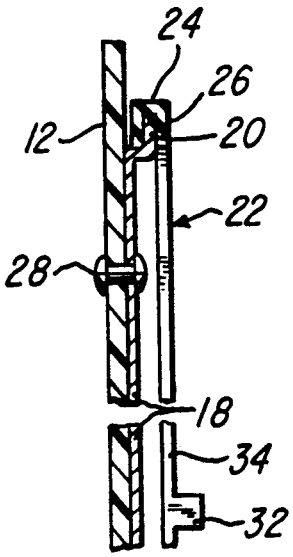
FIG-6
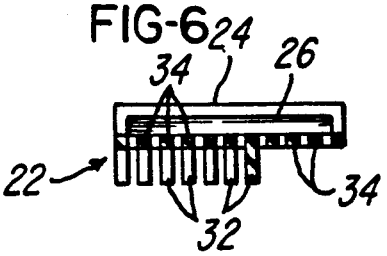

SHEET MUSIC BINDER

SUMMARY OF THE INVENTION

This invention relates to a sheet music binder, and in particular to an improved system for replaceably holding individual pieces of sheet music therein.

A folder or binder for replaceable sheet music is provided with an elastomeric band consisting of an array of parallel stretchable strands. The band is hooked at its ends over outwardly-directed band holders attached to the spine or back panel of the folder. In one form of the invention, the band may be made of flat sheet-like material with adjacent strands being spaced apart laterally. Each band holder on the back panel may comprise a plurality of individual tangs over which the ends of the band are hooked, with the tangs entering the spaces between adjacent strands at the ends of such spaces and thereby holding the band taut in the folder. In another form, the band may be injection molded of an elastomer such as polyurethane, with inwardly-directed pockets at opposite ends of the band hooked over the plurality of tangs as a group or over a band holder which has but a single wide tang. In the molded version of my invention, each strand can be provided with a pull tab for enabling lateral stretching of the strand so as to permit edgewise insertion beneath and withdrawal of sheet music from beneath the laterally stretched strand. In both forms of my invention, the bands and strands are preferably integral, whether formed by molding, stamping, slitting or any other process.

It is an object of this invention to provide a simple and inexpensive sheet music binder in which the primary element for attaching folded sheet music therein is a relatively simple, unitary plurality of parallel strands which comprise portions of a band stretched over a bar fastened to the back panel of the binder.

Another object of the invention is to provide each of the strands with its own pull tab to enable each strand to be stretched out of alignment with the other strands, thereby enabling easy edgewise insertion and withdrawal of sheet music relative to the strands.

Other objects and advantages will be apparent from the description in which reference is made to the accompanying drawings.

BRIEF DESCRIPTION OF THE DRAWINGS

FIG. 4 is a fragmentary view illustrating the manner in which a molded band is hooked over a band holder.

FIGS. 5 and 6 are front and cross-sectional views respectively of the integral band of the FIG. 1 embodiment of my invention, FIG. 6 being taken essentially along lines 6—6 of FIG. 5.

DESCRIPTION OF THE PREFERRED EMBODIMENTS

Figure 1:
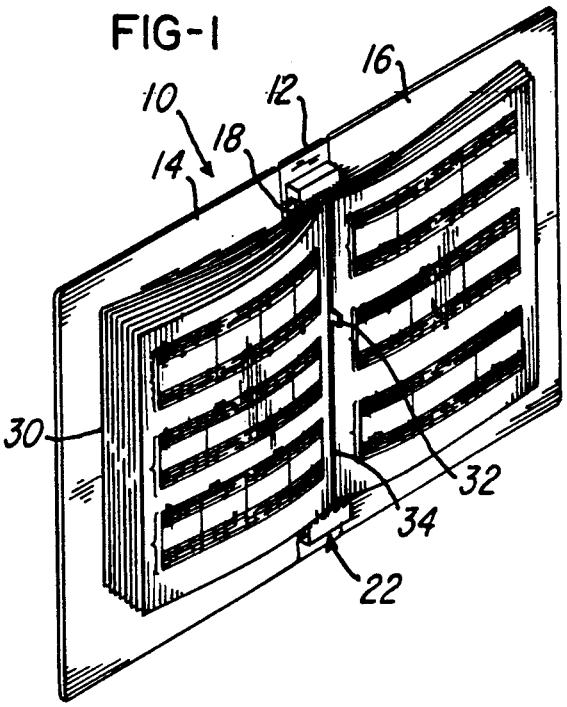
FIG. 1 is a perspective view of a sheet music binder in accordance with my invention, the binder being shown in open condition with a plurality of pieces of sheet music carried thereby.
Figure 2:
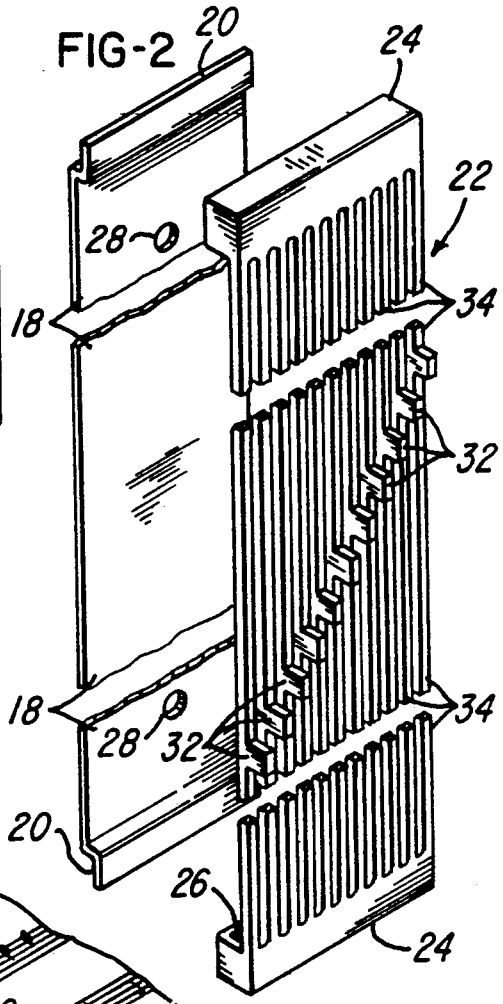
FIG. 2 is a fragmentary exploded view of a molded form of my invention, for mounting on a bar which is fastened to a back panel of a folder.

A sheet music binder in the form of a notebook or folder 10 is shown in FIG. 1. The folder 10 consists of a back panel 12, a front panel 14, and a rear panel 16. The back panel 12 is considered the primary structural element or spine of the notebook 10 and has fastened thereto on its inner surface a bar 18 having an outwardly directed band holder 20 at each end (FIG. 4). A band 22 has a portion 24 at each end thereof in which a pocket 26 is formed to snugly fit over the holder 20. While the band holders 20 may be separate elements mounted at the top and bottom edges on the inside face of the back panel 12, I prefer to utilize the single bar 18 and have offset portions at the ends to form the band-receiving ends of the holders 20. Bar 18 may be fastened in any fashion to the back panel 12, and is simply shown in FIG. 4 as being riveted thereto by means of a rivet 28.

Figure 3:
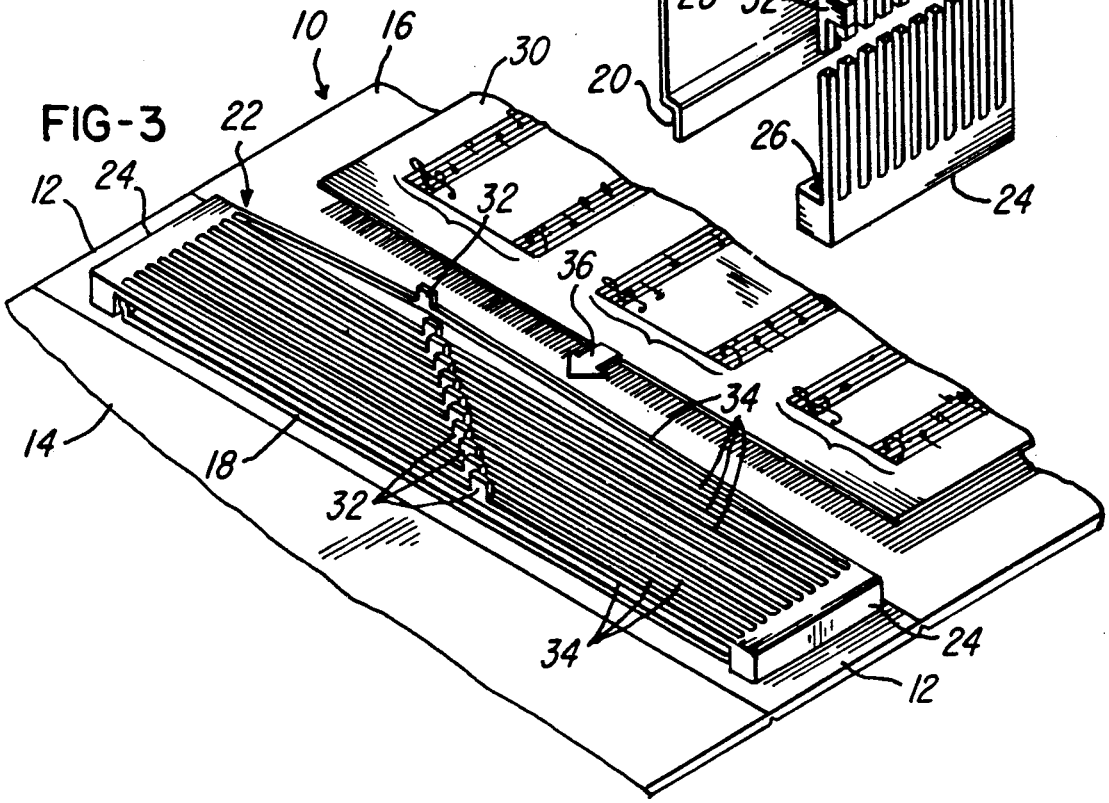
FIG. 3 is a fragmentary view of a folder lying on its back with the elements of FIG. 2 mounted thereon and with one of the strands of the band being stretched or deformed to receive a piece of sheet music.

FIG. 3 shows an empty folder 10, with a first piece of sheet music 30 about to be inserted and held by the folder. To accomplish this, a pull tab 32 is pulled inwardly, i.e., away from the inside face of the back panel 12. This stretches the associated one of strands 34, as shown in FIG. 3 to allow the sheet music 30 to be inserted edgewise beneath the stretched strand. Each of the strands 34 has its own pull tab, and the pull tabs are offset vertically as shown in FIG. 5 for ease of gripping between one's fingers. The pull tabs are placed generally midway between the ends of the strands to provide for easy insertion by deforming each strand from approximately near its center toward its ends.

The band 22 in this embodiment of my invention is preferably made of an injection molded elastomer such as polyurethane. For greatest cost effectiveness, the entire band, including its end portions 24 which contain the pockets 26, the strands 34, and the pull tabs 32 are preferably molded as a single, integral element.

Assuming that a folder has been provided with the bar 18 attached therein, one portion 24 can have its pocket 26 hooked over its respective holder 20, and the band stretched lengthwise until other portion 24 has its pocket 26 hooked over the opposed holder 20. That is the condition of the elements in FIG. 3, where they are ready for insertion of a first piece of sheet music 30 in the direction of arrow 36.

When the band 22 is initially placed over the ends of the holders 20, the band is sufficiently taut so that even if the folder is opened and facing downwardly, the sheet music will be nicely held therein. However, each of the individual strands 34 has sufficient elasticity to enable its deformation as shown in FIG. 3 for inserting and withdrawing sheet music.

Figure 7:
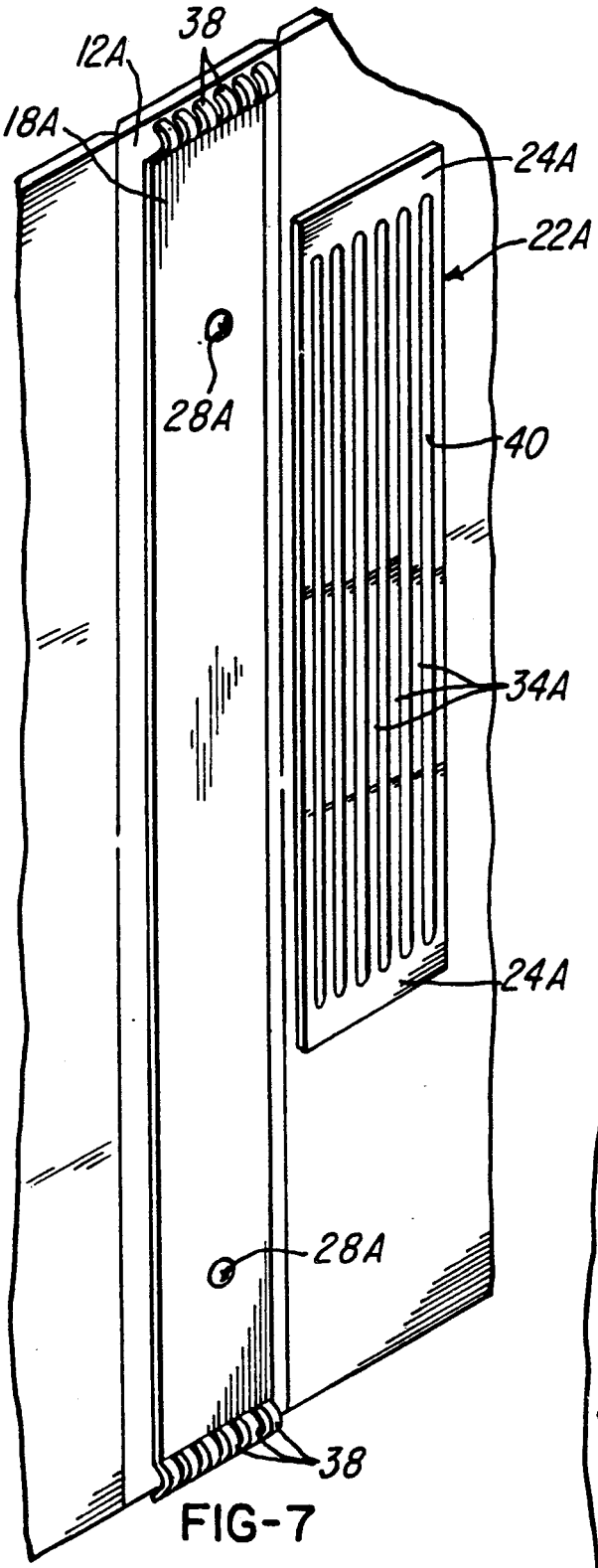
FIG. 7 is a perspective view of a second form of my invention showing the band in relaxed condition and about to be mounted in the folder.
Figure 8:
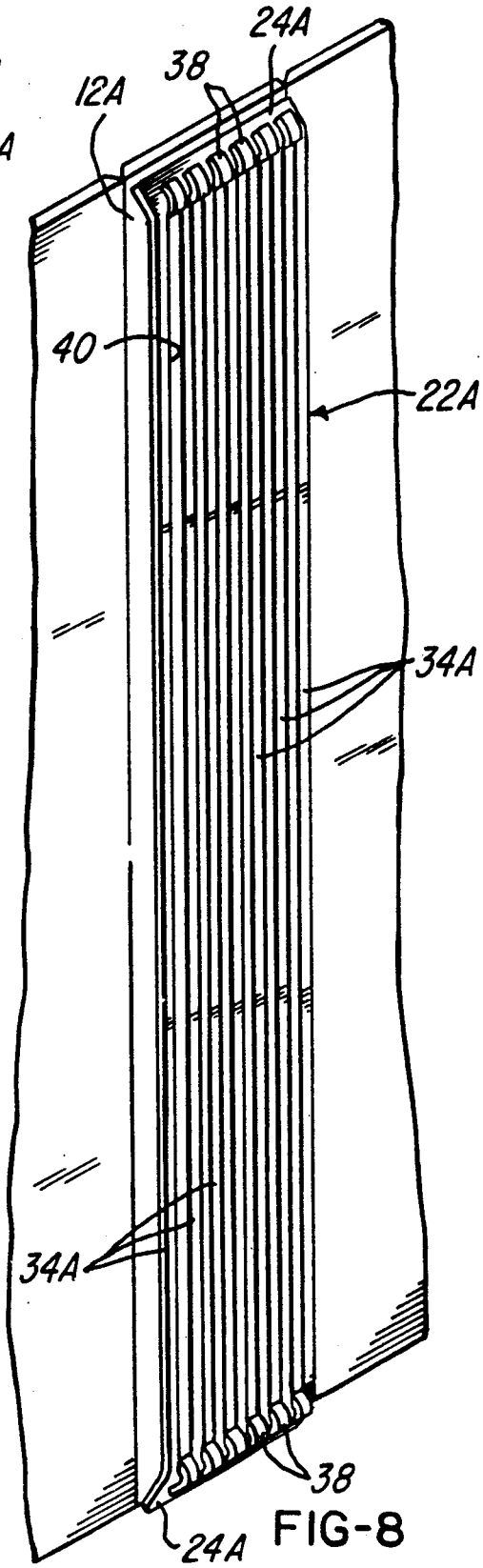
FIG. 8 is a view similar to FIG. 7, illustrating the band in a stretched condition and hooked over a plurality of tangs at the opposite ends of a band holder bar. In such condition, it is ready to receive sheet music.

Referring now to another embodiment of my invention illustrated in FIGS. 7 and 8, a bar 18A is mounted on a back panel 12A by rivets 28A. The band holder in this embodiment includes sets of outwardly-directed tangs 38 at the outer ends of bar 18. A band 22A has a series of strands 34A which perform the identical sheet music supporting function described in the first-described embodiment.

The band 22A is made of flat flexible sheet-like material which may have voids 40 produced between adjacent strands by any of several techniques such as punching, piercing or stamping. The ends of the voids 40 are preferably rounded to minimize the possibility of tearing through the end portions 24A of the band 22A.

As seen in FIG. 7, band 22A is considerably shorter in length than bar 18A. This allows considerable longitudinal stretch of band 22A from the relaxed condition of FIG. 7 to the stretched, sheet music receiving condition of FIG. 8. To accomplish the stretching, one end portion 24A is first caused to have its voids 40 placed over tangs 38 at one end of the bar 18A. The opposite end portion 24A is then gripped, the band 22A stretched and the voids 40 placed over the tangs 38 at the opposite bar end. Once stretched and hooked over tangs 38 at both ends, the band 22A is ready for sheet music installation. Each strand may be gripped by one's fingers and moved out of alignment with the other strands as depicted in FIG. 3. Since the material is not molded as in the version which includes tabs 32, the strands themselves must be gripped. If the embodiment of FIGS. 7 and 8 is molded, it too can then be provided with tabs like 32.

The relaxed length of the bands in both embodiments is determined by the elasticity of the material used, its thickness, the width of the band, and other commonly known factors. Also, while I have described the removal of material between strands 34A to accommodate the thicknesses of adjacent pieces of sheet music, it is believed feasible to merely slit the material to form the strands, possibly punching a hole at each end of each slit to minimize any potential of the slit to tear outwardly through the end portion 24A. When produced in this manner, the widths of the tangs will provide the spaced-apart relation of the strands 34A.

It will be noted that a binder which includes a bar 18A with tangs 38 as the band holders will accept either the type of band 22A described in FIG. 7 and 8 or a band 22 described in the FIGS. 1–6 embodiment. If the latter molded band with pockets 26 is hooked over tangs 38, the width of the pockets 26 should preferably correspond to the dimension between the outside edges of each set of tangs.

Various changes may be made without departing from the spirit and scope of the claims.

Having described my invention, I claim:

1. In a binder for sheet music comprising a narrow, elongated back panel having inner and outer faces, first and second side edges, and first and second ends, and said binder comprising front and rear panels hinged to said side edges of said back panel to form a folder:

a first band holder on said inner face of said back panel adjacent said first end thereof, said first band holder having end portions directed outwardly toward said first end of said back panel;

a second band holder on said inner face of said back panel adjacent said second end thereof, said second band holder having ends directed outwardly toward said second end of said back panel;

a unitary, elongated elastomeric and comprising an array of parallel, sheet music-receiving stretchable strands which extend essentially the length of said band;

said band further having portions at each end thereof which portions are hookable over the outwardly directed end portions of said band holders; and the length of said band between the hookable end portions being less than the distance between said ends of said band holders whereby the band must be stretched lengthwise for hooking over the band holders, and said band being relatively taut after being so hooked over said band holders while individual strands can be readily stretched out of lateral alignment with other of said strands so as to enable sheet music to be inserted edgewise beneath or withdrawn from under each said individual strand.

2. The invention of claim 1 wherein said strands and hookable portions are integrally formed from a flat sheet-like material and wherein the strands are formed by removing elongated strips of the material between adjacent strands so that voids are formed between adjacent strands.

3. The invention of claim 2 wherein each said band holder comprises a plurality of tangs, each tang extending between adjacent strands at the ends of said voids.

4. The invention of claim 1 wherein each said hookable portion is provided with an inwardly-facing pocket offset from a plane containing said strands, said offset pockets being on the side of the band toward said rear panel when said band is stretched and supported on said band holders in said folder.

5. The invention of claim 4 wherein said strands and hookable portions are integrally formed of an injection molded elastomeric material.

6. The invention of claim 5 wherein said material is polyurethane.

7. The invention of claim 1 wherein said band is essentially flat throughout its length containing said strands so as to locate said strands in a common plane.

8. The invention of claim 6 wherein a pull tab is provided on each of said strands, said tabs facing inwardly of said folder and away from said back panel to enable each tab to be finger gripped and stretched out of alignment with the other strands.

9. The invention of claim 8 wherein said strands and pull tabs are integrally formed of an injection molded elastomeric material.

10. The invention of claim 1 wherein said band holders are formed on the ends of an elongated bar that extends lengthwise of said inner face of said back panel.

11. The invention of claim 1 wherein said strands are integrally formed from a flat sheet-like material and are laterally spaced apart to accommodate the thickness of adjacent sheet music pieces.

12. The invention of claim 11 wherein said material is an injection-molded elastomer.

13. Mounting means for removably installing individual folded sheet music pieces in a notebook having a back panel and an outwardly-directed band holder end at each opposite end of said back panel, said mounting means comprising:

a unitary elongated band of elastomeric material having a hookable portion at each end for placement over said band holders and thereby supporting said band adjacent said back panel in said notebook by means of said band holders, and said band including an array of side-by-side strands of a length corresponding to the height of said pieces of sheet music when said band is mounted in a notebook, each of said bands having elasticity to enable each of said strands to be individually pulled further from said back panel than adjacent strands whereby to enable insertion or withdrawal of a piece of sheet music in the space provided when so stretched.

14. Mounting means according to claim 13 wherein a pull tab is connected to each strand to allow finger gripping and pulling of said strands away from said back panel.

15. Mounting means according to claim 14 wherein said hookable portions and strands are integrally formed from an elastomeric material.

16. Mounting means according to claim 15 wherein said elastomeric material is molded polyurethane.

17. Mounting means according to claim 13 wherein said hookable portions and strands are integrally formed from a flat sheet-like material and wherein said strands are formed by removing elongated strips of the material between adjacent strands.

18. Mounting means according to claim 13 wherein each said hookable portion is provided with a inwardly-facing pocket offset from a plane containing said strands, said pocket being of dimensions to hook over the outwardly-directed ends of said band holders when said band is mounted in a notebook.

19. Mounting means according to claim 18 wherein said strands are laterally spaced apart to accommodate the thicknesses of adjacent sheet music pieces.

* * * * *